United States Patent [19]

Temple

[11] Patent Number: 4,624,204

[45] Date of Patent: Nov. 25, 1986

[54] MAST RAISING AND LOWERING DEVICE

[76] Inventor: William A. Temple, 2974 Ingalls Way, Eugene, Oreg. 97405

[21] Appl. No.: 759,753

[22] Filed: Jul. 29, 1985

[51] Int. Cl.[4] ..... B63B 15/00

[52] U.S. Cl. ..... 114/91

[58] Field of Search ..... 114/90, 91, 39, 99, 114/221 R; 248/354.1, 354.3, 354.5, 354.6

[56] References Cited

U.S. PATENT DOCUMENTS

| | | | |
|---|---|---|---|
| 3,827,386 | 8/1974 | Faden | 114/91 |
| 4,042,202 | 8/1977 | Molinari | 248/354.5 |
| 4,448,143 | 5/1984 | Welsh | 114/99 |

*Primary Examiner*—Trygve M. Blix
*Assistant Examiner*—Jesûs D. Sotelo
*Attorney, Agent, or Firm*—John F. Ingman

[57] ABSTRACT

A mast raising and lowering device for sailboats, and particularly sailboats with outboard rudders, which embodies a telescoping pole topped with a roller assembly, the device being attached to the stern of the sailboat where it is used to movably raise and support the mast in a partially elevated position during mast raising and lowering operations. The telescoping pole is attached to the stern of the sailboat by pintle-like pins, which are vertically adjustable on the pole to fit existing gudgeons provided for rudder support and pivoting. The upper section(s) of the telescoping pole is vertically positionable at various extended locations by a pin member. The roller assembly, on the top of the uppermost telescoping pole section, contains a roller member for ease in moving the mast therealong, and may be provided with a pair of flared ears positioned on either side of the roller to aid in receiving and containing the mast. The roller provides a location for retention of the mast during trailering or moorage.

2 Claims, 5 Drawing Figures

MAST RAISING AND LOWERING DEVICE

BACKGROUND OF THE INVENTION

1. Field of the Invention

The present invention generally relates to means for raising and lowering masts on sailboats and, more particularly, is concerned with the raising and lowering of the mast on sailboats with an outboard rudder.

2. Description of the Prior Art

The raising and lowering of the mast on a sailboat can be a difficult job, especially when only a limited number of hands are available. The weight and length of the mast, and the lack of available control, especially when the mast is near the horizontal and extending well beyond the dimensions of the sailboat, make the raising and lowering operation difficult and even perilous. The problem are especially evident on smaller sailboats of 20 feet to 25 feet in length where the crew may consist of as few as two (2) sailors. Many of these sailboats are also characterized by the use of a removable outboard rudder.

There is a definite need for a device which will make it easier and safer to raise and lower the mast on a sailboat.

SUMMARY OF THE INVENTION

The present invention provides a mast raising and lowering device which is designed to satisfy the aforementioned need, particularly for, but not limited to, sailboats fitted with an outboard rudder The invention embodies a telescoping pole, topped with a roller assembly and attached to the stern of a sailboat, which serves to movably support the mast in an partially elevated position during the mast raising and lowering operation.

Accordingly, the present invention provides a telescoping pole which is selectively attached to the stern of a sailboat by pintle-like pins, which, for sailboats with outboard rudders, are vertically adjustable on the pole to fit into the already existing gudgeons provided for rudder support and pivoting. An additional attachment point may be provided at the sailboat's stern railing. The inner and upper section of the telescoping pole is vertically positionable at various extended locations by a pin member. The extension of the telescoping pole raises the upper portion of the mast to a partially elevated position. On the top of the uppermost telescoping pole section is mounted a roller member which may be contained within a pair of flared ears positioned on either side of the roller. The mast is movable along the roller member when being moved into position for stepping. When in the down position, as in trailering or moorage, the mast normally is retained on the roller.

DESCRIPTION OF THE PREFERRED EMBODIMENT

Figure 1:
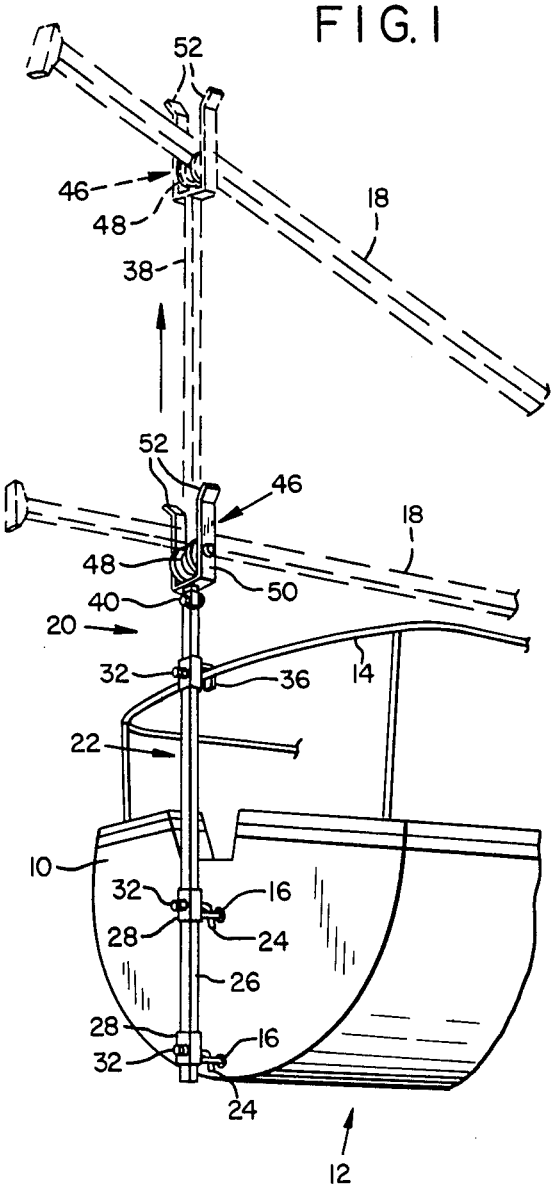
FIG. 1 illustrates in perspective a sailboat stern with the preferred embodiment of the mast raising and lowering device attached, showing its extended position in phantom.

Referring now to the drawings, and more particularly to FIG. 1, there is shown the stern portion 10 of a sailboat 12 to which is attached a stern railing 14 of conventional type. The sailboat 12 illustrated is of the type which utilizes an outboard rudder (not shown), the outboard rudder being attached and supported for use at the stern 10 by means of pintles extending through brackets (termed gudgeons) 16 affixed to the stern 10. Such outboard rudder is readily removable when not needed for operation of the sailboat, leaving the gudgeons 16 available for other use.

Figure 2:
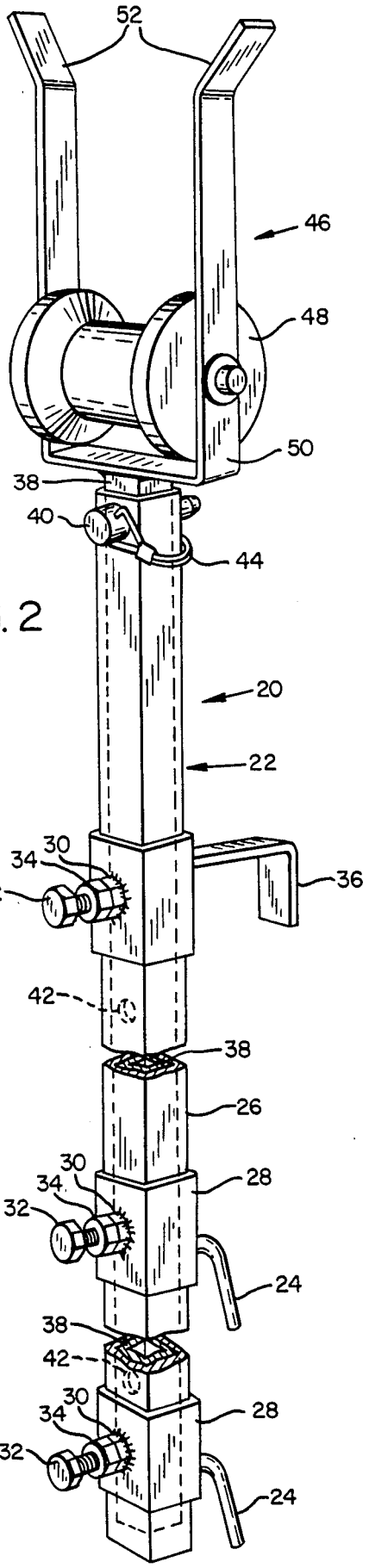
FIG. 2 provides a perspective view of portions of the mast raising and lowering device of FIG. 1.
Figure 3:
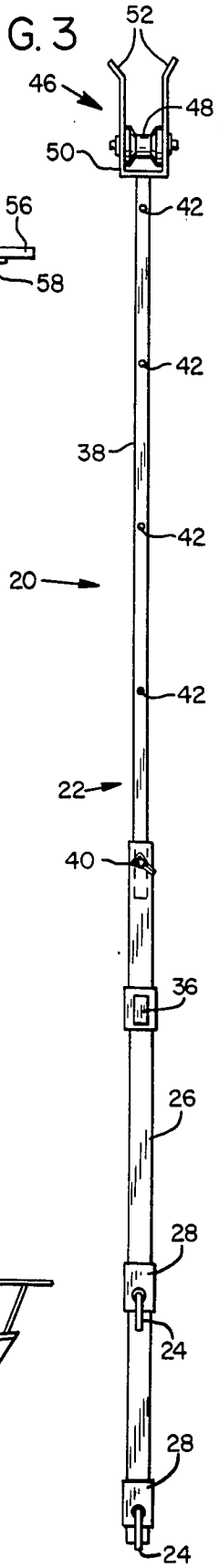
FIG. 3 illustrates the mast raising and lowering device of FIG. 1 and FIG. 2 in full extension.

The preferred embodiment of the mast raising and lowering device 20 is shown in FIG. 1 as attached to the sailboat 12, in FIG. 2 in enlarged detail, and in FIG. 3 in extended position. The preferred embodiment includes a two (2) section telescoping pole 22 approximately five (5) feet in length per section, which becomes approximately 9½ feet in length when fully extended. The telescoping pole 22 attaches to the stern 10 of the sailboat 12 by pintle-like pins 24 which fit into the already existing gudgeons 16, the outboard rudder having been previously removed. The pintle-like pins 24 are adjustably connected to the base section 26 of the telescoping pole 22 by an encircling sleeve 28. On one side of sleeve 28, through a nut 30 welded thereto, a threaded bolt 32 extends, so that, when tightened, the end of the bolt 32 presses firmly against the base section 26, thus holding the sleeve 28, with pintle-like pins 24 welded or otherwise attached thereto, securely attached to the base section 26. A second nut 34 is used to hold bolt 32 in a tightened position. By loosening the bolts 32, the sleeves 28 are adjustable up and down the base section 26 so as to accomodate various positioning of gudgeons 16. While not essential, additional support is obtainable by the use of a bracket 36 which hooks over the stern railing 14 of sailboats so equipped. This hooking bracket 36 is adjustably fastened to the base section 26 of the telescoping pole 22 through welding or other attachment to a sleeve 28, nut 30, bolt 32 and nut 34 arrangement identical to the above described vertically adjustable connection of the pintle like pins 24, so as to accomodate various heights of stern railing 14.

As indicated above, in the preferred embodiment, the telescoping pole 22 includes two (2) telescoping sections which are preferably, but not necessarily, of square steel tubing, the base section 26 being secured to the sailboat stern 10 and the upper (and inner) section 38 being raisable. The upper section 38 is positionable at its lower unextended and various extended positions by means of a pin 40 extending through the base section 26 near its upper end and through one of several spaced apertures 42 in the upper section 38, as are best illustrated in FIG. 3. The pin 40 should be of the type which is restrained in position once inserted, such as by a wire latching-type member 44 as is commonly available.

On the top of the upper section 38 of the telescoping pole 22 is mounted a roller assembly 46, wherein a roller 48 is rotatably mounted in a conventional manner on a roller mounting bracket 50 attached to upper section 38. The roller mounting bracket 50 extends upward and outward on each side of the roller 48, these wing- or ear-like projections 52 providing a wider and deeper configuration for receiving and containing the sailboat mast 18.

Returning to FIG. 1, the mast raising and lowering device 20 is shown in perspective attached to the sailboat 12 in a lowered position, with the mast 18, in phantom, resting on the roller assembly 46. The illustration also shows, in phantom, the telescoping upper section 38 in a raised position, carrying with it the mast 18, still in phantom, to a partially elevated position.

Figure 4:
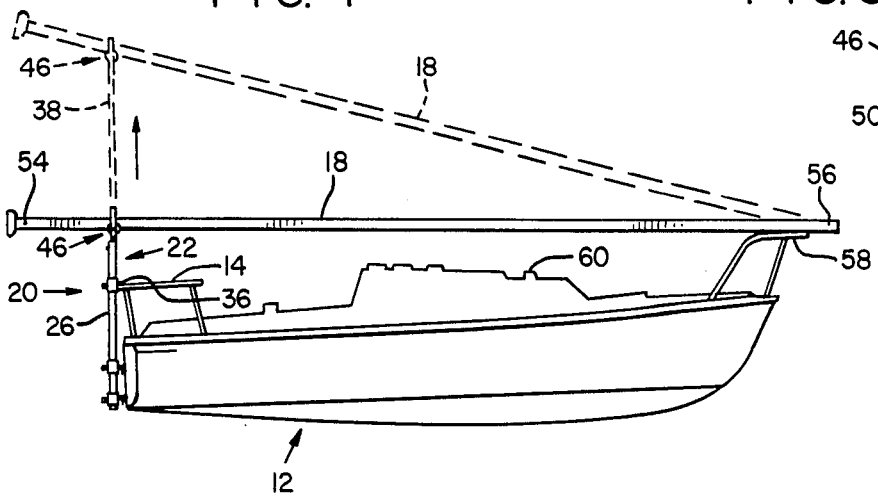
FIG. 4 provides a side view of a sailboat, the present invention being mounted, with the mast at trailering or moorage position, and, in phantom, with the mast at an intermediate mast raising or lowering position.
Figure 5:
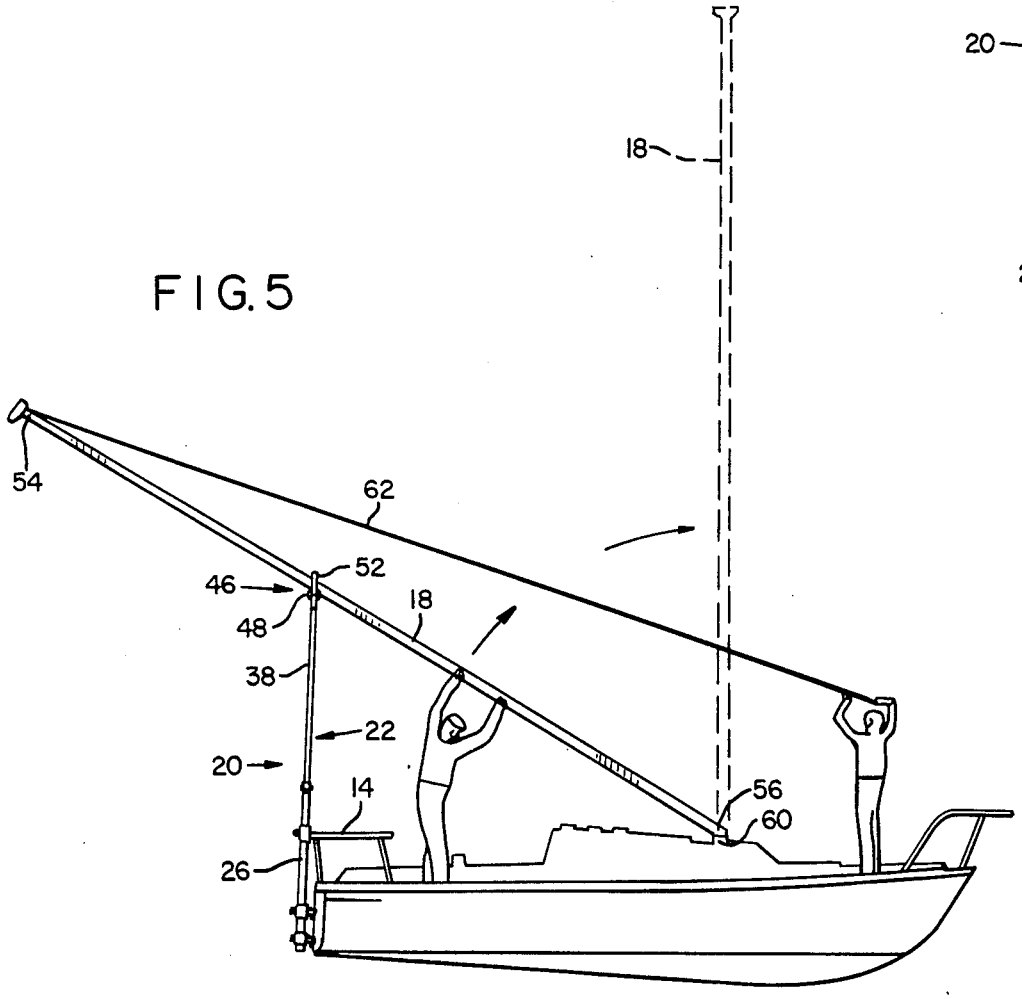
FIG. 5 provides a side view of a sailboat, with the present invention mounted, showing the mast at a different intermediate mast raising or lowering position than illustrated in FIG. 4, and, in phantom, with the mast in a raised positon.

The method of use of the mast raising and lowering device 20 is more clearly illustrated in FIG. 4 and FIG. 5. In FIG. 4, the sailboat 12 is shown with its mast 18 in the down position with the device 20 in the lowered position, that is, with the telescoping pole 22 not extended. This position, with the upper end 54 of the mast 18 resting on the roller 48 and the mast base 56 on the bow railing 58, is the normal position for trailering and moorage.

In FIG. 4, in phantom, is shown the mast raising and lowering device 20 in a raised position, the telescoping pole 22 having been extended, the first step in mast raising.

In FIG. 5 is shown the results when, with the device 20 in an extended position, the mast base 56 has been moved from the bow of the sailboat rearward to the mast step 60, that is, the attachment near the center of the sailboat 12 for fastening the mast base 56 to the sailboat. This movement of the mast 18 has been greatly facilitated by the roller assembly 46, with its roller 48 and containing ears 52, and by the control afforded by the partial elevation of the upper mast end 54.

Finally, in FIG. 5, the mast 18, in phantom, is shown in the fully raised position, the raising having been accomplished by forward lines 62 and direct physical lifting of the mast 18 from the already partially raised position provided by the extended mast raising and lowering device 20. From the partially raised position, the ability of lines to assist in the raising and control of the masts is greatly enhanced due to the line angle thus provided.

Subsequently, the telescoping pole 22 is retracted, and the whole device 20 is raised to separate the pintle-like pins 24 and the stern railing bracket 36, if used, from the gudgeons 16 and the stern railing 14 respectively, and is brought aboard and stowed until needed to lower the mast. Replacing the device 20 in the gudgeons 16 may be the outboard rudder (not shown), as needed for actual sailing.

Lowering the mast is accomplished in the reverse order, i.e., by replacing the outboard rudder with the mast raising and lowering device 20, extending the telescoping pole 22, lowering the mast 18 by line 62 and physical holding into the elevated roller assembly 46, releasing the connection between the mast base 56 and the mast step 60, moving the mast base 56 forward with the top portion of the mast moving easily on the roller assembly 46, and finally lowering the telescoping pole 22 so that the mast 18 is in an approximately horizontal position for trailering or moorage. While the mast lowering operation is thus described only briefly, the procedure believed to be clear in the context of mast raising, the importance of the mast raising and lowering device 20 in the lowering operation should not be underestimated. A potentially hazardous condition results while lowering the mast, especially in choppy seas. The mast being lowered and controlled at least partially by forward line, the effectiveness of which becomes minimal as the mast approaches the horizontal, and the mast extending well beyond the stern of the sailboat, combine to create an anxious situation for a person at the stern who may otherwise have to attempt to "catch" the mast. With the mast raising and lowering device 20 in place, in extended position, the mast 18 is lowered into the waiting ears 52 of the roller assembly 46 while the mast 18 is still at an angle where control can be provided by the forward lines. The mast 18 is thereafter easily handled and secured.

While the preferred embodiment of the mast raising and lowering device 20 has been specifically designed to utilize the gudgeons which exist on outboard rudder sailboats, it is clear that the scope of this invention extends to other type sailboats, similar brackets easily being installable on sailboats where such gudgeons are not already available. Similarly, while only an approximately 9½ foot, two-section telescoping pole was used in the preferred embodiment, a different pole length with a greater number of telescoping sections would also fall within the scope of this invention for various sailboat sizes and configurations.

It is thought that the mast raising and lowering device of the present invention and its many attendant advantages will be understood from the foregoing description and that it will be apparent that various changes in form, construction and arrangement of the parts thereof without departing from the spirit and scope of the invention or sacrificing all of its material advantages, the form hereinbefore described being merely an exemplary embodiment thereof.

I claim:

1. A mast raising and lowering device for sailboats comprising:

(a) an adjustable telescoping pole assembly;

(b) means for attaching said telescoping pole assembly to the stern of a sailboat which employs an outboard rudder, which means include pintle-like pin attachment members, adjustably connected to the base section of the said telescoping pole so that the pintle-like pins fit into, and the said telescoping pole is supported by, those already existing gudgeons which are otherwise used to mount the outboard rudder and are available when the outboard rudder is removed; and (c) a roller located on the topmost portion of said telescoping pole assembly;

wherein, in a mast raising operation, the mast being normally retained in an approximately horizontal, down position on the roller during trailering and moorage of the sailboat with the base of the most forward and the top of the mast to the stern, the said telescoping pole assembly is extended upwards, thereby lifting the top portion of the mast at the stern of the sailboat; the mast is then supportedly moved on said roller towards and over the stern of the sailboat so as to locate the base of the mast in its proper position for connection to the sailboat for raising; and finally the mast is raised from its partially elevated position atop the said roller and expanded telescoping pole assembly to its final vertical position;

and, in lowering the mast from the vertical position to the horizontal, first the telescoping pole assembly is extended upwards so as to provide an elevated catching and resting place for the mast on the roller; next the mast is lowered to said elevated position; the base of the mast is then detached from the sailboat and moved forward, the mast moving supportedly on the roller atop the elevated pole assembly; and finally the telescoping pole assembly is retracted downwards into the approximately horizontal position used for trailering and moorage.

2. The mast raising and lowering device, recited in claim 1, wherein a pair of flared ears are positioned vertically on either side of said roller to guide the mast onto said roller and to retain it thereon against sideward movement.

* * * * *